US012624560B2

(12) United States Patent
Wanke et al.

(10) Patent No.: US 12,624,560 B2
(45) Date of Patent: May 12, 2026

(54) CONCRETE SCREEDING DEPTH AND LEVELING TOOL

(71) Applicants: Richard Ray Wanke, Eau Claire, WI (US); Todd Melby, Eau Claire, WI (US)

(72) Inventors: Richard Ray Wanke, Eau Claire, WI (US); Todd Melby, Eau Claire, WI (US)

(73) Assignee: Whitetail Management LLC, Eau Claire, WI (US)

( * ) Notice: Subject to any disclaimer, the term of this patent is extended or adjusted under 35 U.S.C. 154(b) by 924 days.

(21) Appl. No.: 17/457,182

(22) Filed: Dec. 1, 2021

(65) Prior Publication Data

US 2022/0170279 A1 Jun. 2, 2022

Related U.S. Application Data

(60) Provisional application No. 63/199,009, filed on Dec. 1, 2020.

(51) Int. Cl.
*E01C 23/01* (2006.01)
*E04G 21/10* (2006.01)

(52) U.S. Cl.
CPC ..... *E04G 21/10* (2013.01); *E01C 23/01* (2013.01)

(58) Field of Classification Search
CPC ..... E01C 23/01
See application file for complete search history.

(56) References Cited

U.S. PATENT DOCUMENTS 1,243,713 A 10/1917 Colarusso
1,320,352 A * 10/1919 Werner ..... G01C 15/06 33/375
1,683,247 A * 9/1928 Grothe ..... E04F 21/05 52/678
2,224,273 A * 12/1940 Neptune ..... E04F 21/05 52/679
2,319,526 A * 5/1943 Wearn ..... E01C 19/502 52/678
2,551,826 A * 5/1951 Cox, Sr. ..... E04F 21/05 52/678
2,835,017 A * 5/1958 Hoerr ..... B28B 7/0014 249/207

(Continued)

FOREIGN PATENT DOCUMENTS

KR 100428285 B1 * 4/2004

*Primary Examiner* — William D Hutton, Jr.
*Assistant Examiner* — Katherine J Chu
(74) *Attorney, Agent, or Firm* — Dunlap Bennett & Ludwig PLLC; Anna L. Kinney

(57) ABSTRACT

A concrete screeding tool includes an elongated stake, a disk, and a bar. The stake has a longitudinal axis, an outer surface, a first end, and a second end. The disk extends radially from the outer surface. The bar is spaced from the outer surface and is parallel to the longitudinal axis. Slurry depth is measured by vertically positioning the concrete screeding tool spaced from an outer frame; pouring a slurry into the frame; placing a screeding board between the bar and the elongated stake and on the outer frame; and leveling the slurry with a sawing motion. The tool is small and durable, is easy to set up and clean, prevents dips in concrete, makes bull floating concrete easier, and can save man hours in screeding the concrete level.

3 Claims, 4 Drawing Sheets

(56) References Cited

U.S. PATENT DOCUMENTS

| | | | | | |
|---|---|---|---|---|---|
| 2,867,041 | A | | 1/1959 | McMillan | |
| 2,873,529 | A | * | 2/1959 | Hogan | E01C 23/05 33/375 |
| 3,284,973 | A | * | 11/1966 | Ames | E01C 23/01 52/155 |
| 3,758,062 | A | * | 9/1973 | Caldwell | E04F 21/05 248/156 |
| 4,066,237 | A | | 1/1978 | Bentz | |
| 4,232,847 | A | | 11/1980 | Cooper | |
| 4,411,404 | A | * | 10/1983 | Weisbach | E01C 11/08 249/6 |
| 4,459,787 | A | * | 7/1984 | Wilcox | E02D 5/80 135/15.1 |
| 4,669,941 | A | | 6/1987 | West et al. | |
| 4,924,579 | A | | 5/1990 | Berendsen | |
| 5,230,187 | A | * | 7/1993 | Reimann | E04G 13/00 248/156 |
| 5,257,764 | A | * | 11/1993 | Spaulding | E04G 21/10 404/96 |
| 5,605,415 | A | * | 2/1997 | Shamblin | E04F 21/241 404/97 |
| 5,943,784 | A | * | 8/1999 | Hiramine | G01C 15/02 116/DIG. 16 |
| 6,230,451 | B1 | * | 5/2001 | Stoller | A63C 19/10 52/169.7 |
| 6,578,814 | B2 | * | 6/2003 | Hoyle | E04G 9/08 249/3 |
| 6,668,417 | B1 | * | 12/2003 | Slattery | G01C 9/26 15/235.4 |
| 7,478,510 | B2 | * | 1/2009 | Wilson | E04G 13/00 52/153 |
| 7,637,072 | B2 | | 12/2009 | Parish | |
| 7,685,729 | B2 | | 3/2010 | Mershon | |
| 7,878,469 | B2 | | 2/2011 | Hasenoehrl et al. | |
| 7,963,082 | B1 | | 6/2011 | Bauer | |
| 8,104,992 | B2 | * | 1/2012 | Biodrowski | E04F 21/242 404/118 |
| 9,765,533 | B2 | * | 9/2017 | Lutes | E01C 23/01 |
| 9,863,158 | B1 | | 1/2018 | Adam et al. | |
| 10,174,511 | B2 | * | 1/2019 | Lutes | F16B 7/22 |
| 10,247,391 | B2 | * | 4/2019 | Adams, IV | F21V 17/164 |
| 10,508,946 | B2 | * | 12/2019 | Lutes | G01F 23/0007 |
| 2007/0001089 | A1 | * | 1/2007 | Moblo | E04G 13/00 249/208 |
| 2017/0233999 | A1 | * | 8/2017 | Gilman | F16M 11/28 248/542 |
| 2021/0051856 | A1 | | 2/2021 | Olson et al. | |
| 2021/0123251 | A1 | * | 4/2021 | Turk | E04G 21/10 |
| 2022/0251859 | A1 | * | 8/2022 | Terstriep | E04F 21/241 |
| 2023/0074536 | A1 | * | 3/2023 | Baggaley | E04G 21/10 |
| 2024/0068251 | A1 | * | 2/2024 | Baar | E04G 21/10 |

* cited by examiner

CONCRETE SCREEDING DEPTH AND LEVELING TOOL

CROSS-REFERENCE TO RELATED APPLICATION

This application claims the benefit of priority of U.S. provisional application No. 63/199,009, filed Dec. 1, 2020, the contents of which are herein incorporated by reference.

BACKGROUND OF THE INVENTION

The present invention relates to concrete screeding and, more particularly, to a depth and leveling tool therefor.

To prevent dips in concrete, a screed device must be used to level the concrete. Commercially available screed devices either do not secure or hold the screed board at an accurate depth or they are disruptive and time consuming to remove and/or cleanup and transport.

As can be seen, there is a need for a device that consistently provides an accurate screeding depth and is easy to remove and/or clean and transport.

SUMMARY OF THE INVENTION

The present invention provides a relatively small and durable tool that prevents dips in concrete and can save man hours in screeding the concrete level. The tool may be used in conjunction with current screeding methods. The inventive tool also makes bull floating concrete easier.

The inventive device provides a fixed depth point in the middle of or in hard to get at places in a concrete pour. It is easy to set up, particularly in tight spots or hard to get at corners. The device holds one end of the screed board and is spinnable. It is also easily removed during the pour. It is easy to clean after the job is done and can, in some cases, eliminates the need for one crew member during the screeding process.

In one aspect of the present invention, a concrete screeding tool is provided, comprising an elongated stake having a longitudinal axis, an outer surface, a first end, and a second end; a disk extending radially from the outer surface; and a bar spaced from the outer surface and parallel to the longitudinal axis.

In another aspect of the present invention, a method of measuring a slurry depth, is provided, comprising: positioning the concrete screeding tool vertically such that it is spaced a predetermined distance from an outer frame; pouring a slurry into the outer frame; placing a screeding board between the bar and the elongated stake and on the outer frame; and leveling the slurry with a sawing motion.

These and other features, aspects and advantages of the present invention will become better understood with reference to the following drawings, description, and claims.

DETAILED DESCRIPTION OF THE INVENTION

Figure 1:
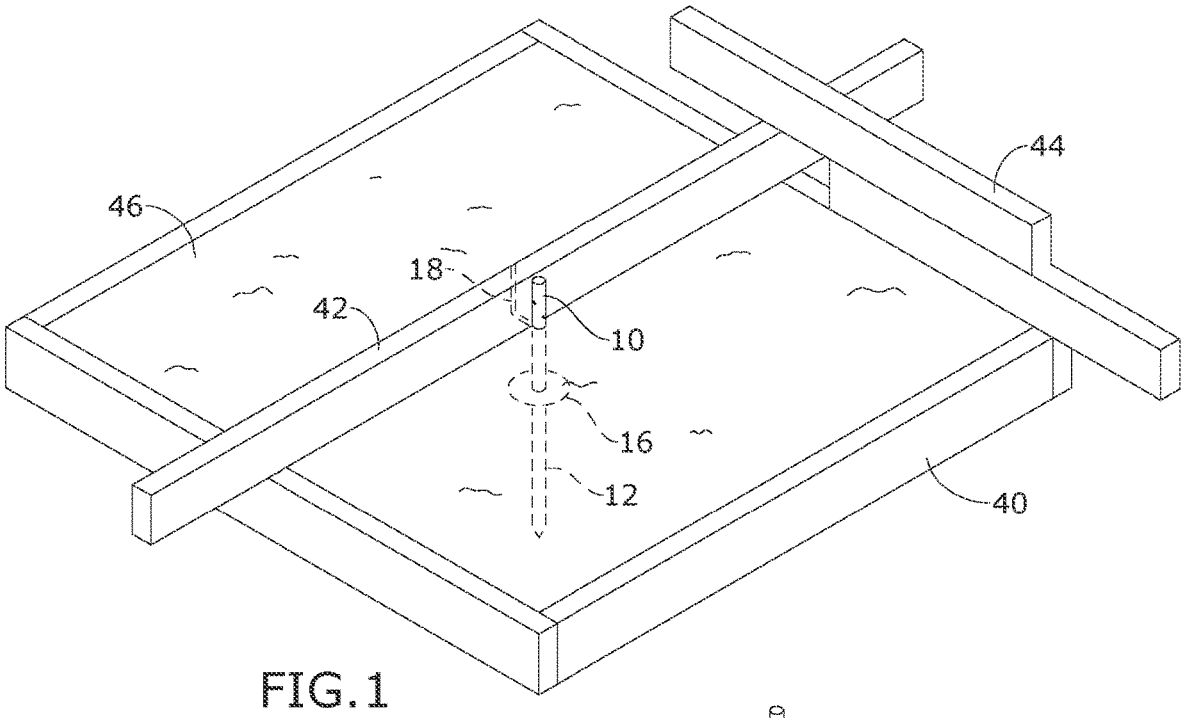
FIG. 1 is a perspective view of a screeding tool according to an embodiment of the present invention, shown in use.
Figure 2:
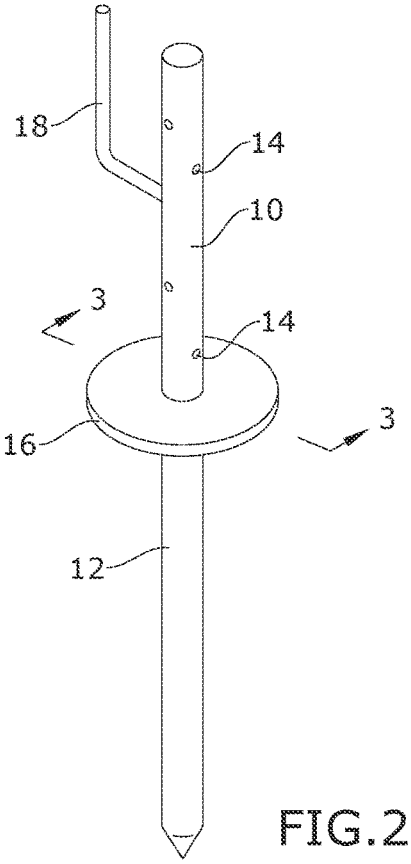
FIG. 2 is an enlarged perspective view thereof.

The following detailed description is of the best currently contemplated modes of carrying out exemplary embodiments of the invention. The description is not to be taken in a limiting sense but is made merely for the purpose of illustrating the general principles of the invention, since the scope of the invention is best defined by the appended claims.

Broadly, one embodiment of the present invention is a tool comprising a stake with a disk and an L-shaped bar.

In some embodiments, the inventive tool may be a single, unitary piece.

In some embodiments, the stake may comprise two pieces: an upper portion and a lower portion. The upper portion may form a sleeve over the lower portion and may rest on a groove. The lower portion of the device may be left in the pour and the upper portion may be removed.

In some embodiments, the lower portion of the device includes the disk or round base and the upper portion of the device includes the L-shaped bar or bracket. The lower portion may be detachable from the upper portion for easier removal.

In some embodiments, the upper portion of the device includes the L-shaped bar and the disk.

In some embodiments, the lower portion of the spike has a pointed end to improve ground penetration.

The tool may be used to measure the depth of any slurry which will harden into a solid. For example, the inventive device may be used as a stationary point in the middle of a concrete or flooring emulsion pour to provide an accurate depth measurement. The device may be positioned where the concrete will be poured, at a suitable distance from an outer frame. For example, an end of a screed board preferably reaches the device with enough slack to allow a sawing motion when leveling. The device may be pounded into the ground to a depth where the disk is at ground level. The device may then support one end of the screed.

The materials and methods of manufacture are not particularly limited. The components may comprise, for example, steel, aluminum, hard plastic, or any combination thereof. The components may be welded and/or injection molded as a single unitary piece or as multiple mating pieces.

The measurements of the various component parts are generally selected to ensure accurate concrete depth gauge and to support the screed. The stake may be about ⅝ inch to about ⅞ inch in diameter, such as about ¾ inch, and may be about 12 inches to about 24 inches long, such as about 18 inches in length. The holes, or bores, may be about ⅛-inch to about ¼-inch, such as about 3/16-inch and may be orthogonal to a longitudinal axis of the stake. The L-shaped bar may be round, with a diameter of about ⅛ inch to about ⅜ inch, such as ¼-inch. The L-shaped bar may have a leg that extends laterally about 1½ inches to about 3 inches from the spike, such as about 1 9/16 inches. The holes in the stake may be both parallel and perpendicular to the position of the L-shaped bracket on the spike. The disk may be round, about ⅛-inch thick to about ⅜-inch thick, such as about ¼-inch thick, with a diameter of about 2 inches to about 5 inches, such as about 3½ inches, and having a corresponding circumference. The disk may be welded to the stake at a position about 7 to 10 inches from the top of the stake, such as about 7½ inches, about 8½ inches, or about 9½ inches from the top. The measurement from the round disk to the L-shaped bar may be various lengths, generally from about 3 inches to about 7 inches, e.g., about 4 inches, about 5 inches, or about 6 inches. This measurement may depend upon a predetermined concrete depth. Preferably, the components have a thickness that will allow it to be pounded into the ground as a stake without breaking.

Figure 3:
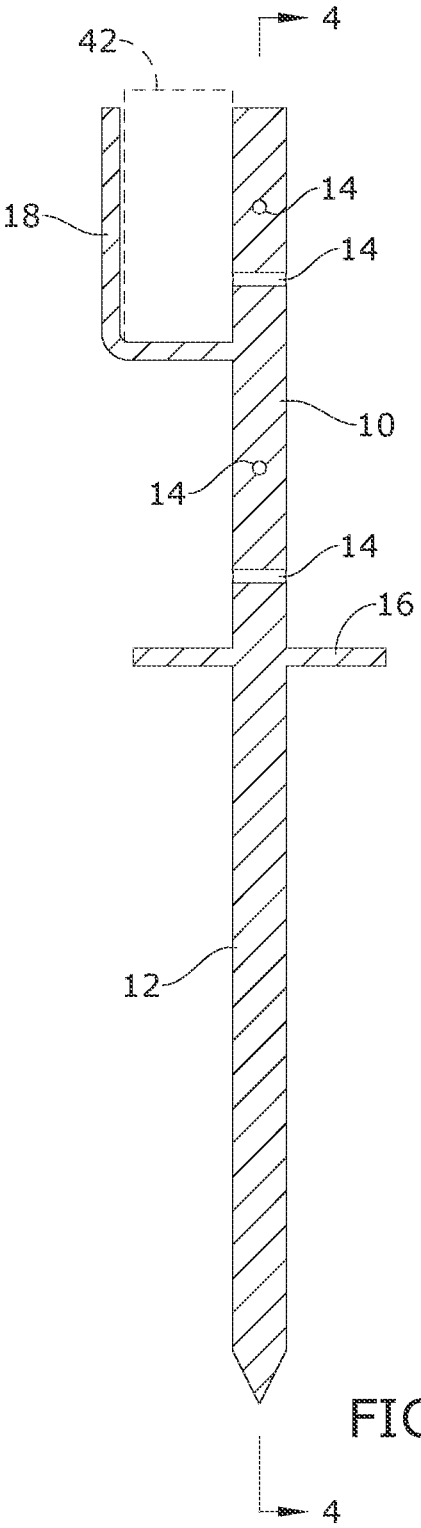
FIG. 3 is a sectional view thereof, taken along line 3-3 in FIG. 2.
Figure 4:
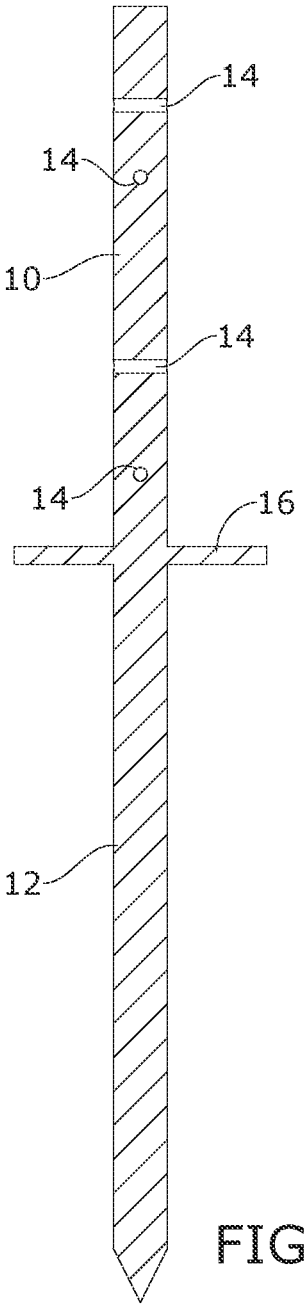
FIG. 4 is another sectional view thereof, taken along line 4-4 in FIG. 3.

Referring to FIGS. 1 through 7, FIGS. 1 through 4 show a screed tool according to an embodiment of the present invention positioned in poured concrete 46 in a form 40, with most of the screed tool shown in broken lines indicating that it is hidden by the concrete 46. The screed tool comprises an upper stake 10, a lower stake 12, a disc 16, and an L-bar 18. The upper stake 10 and the lower stake 12 each have a substantially solid cylinder shape. A screed guide board 42 may rest between the upper stake 10 and the L-bar 18 and across upper surfaces of the form 40. A guide screed 44 may be supported on the screed guide board 42 and the form 40. A user may slide the guide screed 44 along the screed guide board 42 to level the poured concrete 46. The device is shown more clearly in FIG. 2, with a plurality of stake holes 14 or bores in alternating horizontal directions perpendicular to one another within the upper stake 10, as seen in FIGS. 3 and 4.

Figure 5:
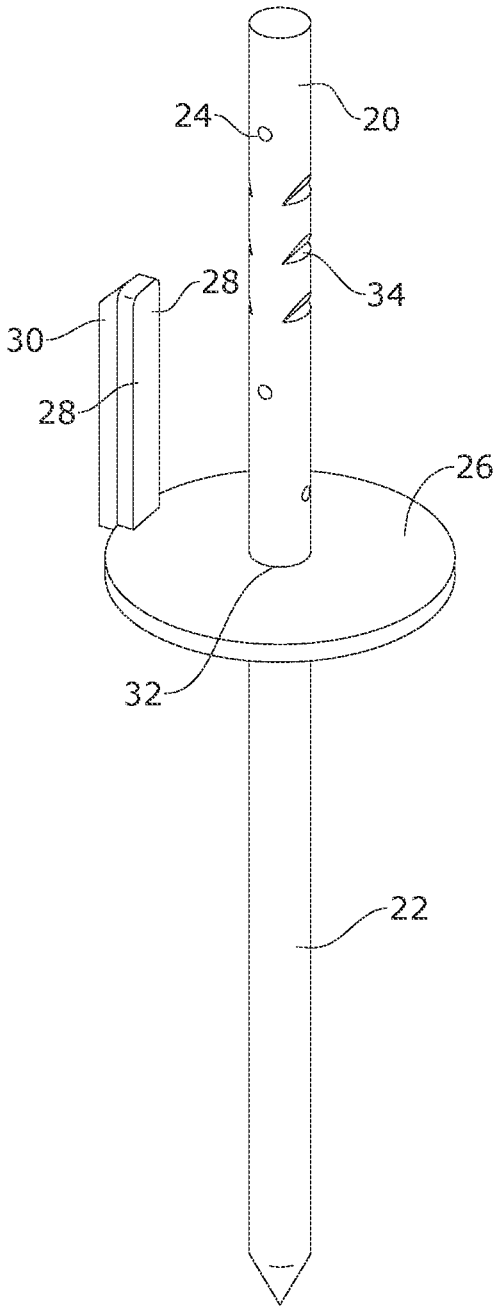
FIG. 5 is a perspective view of a screeding tool according to another embodiment of the present invention.
Figure 6:
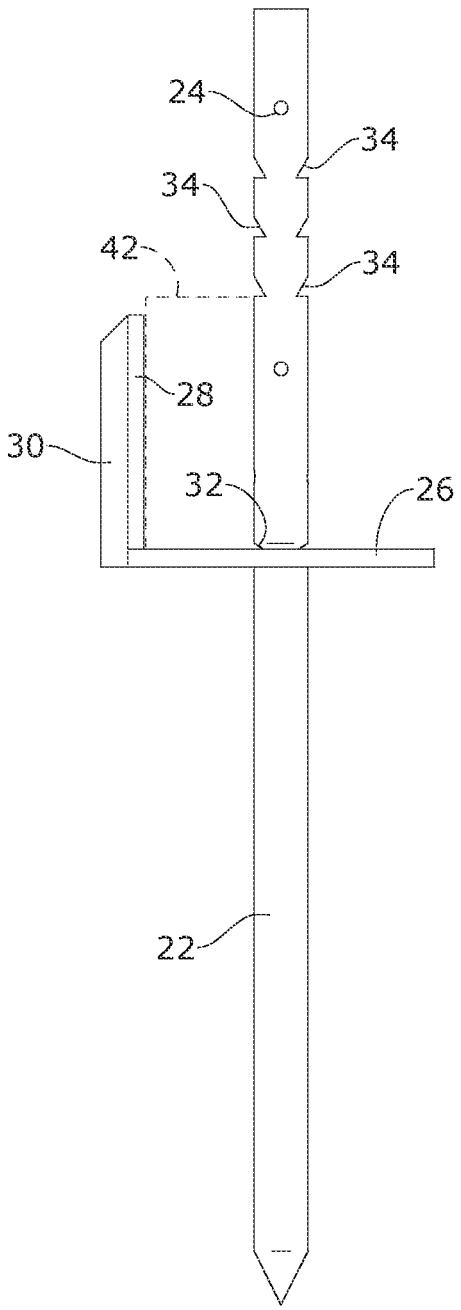
FIG. 6 is a side elevational view thereof.
Figure 7:
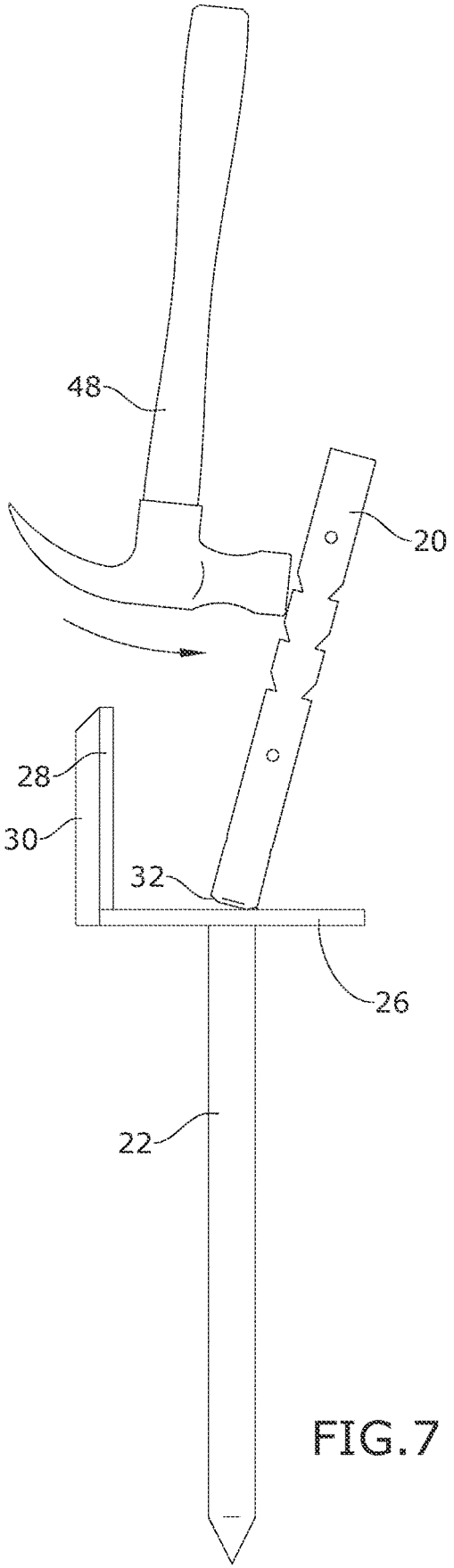
FIG. 7 is a side elevation view thereof, showing a step of separation.

A screed tool according to another embodiment of the present invention is shown in FIGS. 5 through 7, comprising an upper stake 20, a lower stake 22, stake holes 24, and a disc 26, as well as a guide bracket 28 with a reinforcing fin 30, which serves to support the screed guide board 42 in use, as shown in FIG. 6. Premeasured line guide notches 34 for use with a straight line or string are formed in the upper stake 20. The upper stake 20 is scored to provide a weak point 32 at a junction with the disc 26, which may be severed with a hammer 48, as shown in FIG. 7.

It should be understood, of course, that the foregoing relates to exemplary embodiments of the invention and that modifications may be made without departing from the spirit and scope of the invention as set forth in the following claims.

What is claimed is:

1. A measuring and supporting tool for use with concrete slurry, comprising:

an elongated stake having an upper stake portion and a lower stake portion, the upper stake portion including a plurality of pre-measured line guide notches;

a disk extending radially from the lower stake portion, configured to rest at ground level when the tool is pounded into the ground; and a guide bracket extending from a margin of the disk, the guide bracket being parallel to the upper stake portion, forming a slot between the upper stake portion and the guide bracket configured to support a board;

wherein the upper stake portion is formed with a circumferential notch at a junction between the upper stake portion and the disk, the circumferential notch defining a weakened break point; and wherein the elongated stake, the disk, and the guide bracket are formed as a single unitary piece.

2. The measuring and supporting tool of claim 1, wherein the guide bracket further comprises a reinforcing fin formed longitudinally along a surface thereof.

3. The measuring and supporting tool of claim 1, wherein the upper stake portion comprises bores formed therethrough orthogonal to the longitudinal axis.

* * * * *